United States Patent [19]

Knothe et al.

[11] Patent Number: 4,472,660

[45] Date of Patent: Sep. 18, 1984

[54] CIRCUIT FOR FLUORESCENT SIGNALING DEVICE

[75] Inventors: Erich Knothe, Bovenden; Franz-Josef Melcher, Hardegsen; Christian Oldendorf, Göttingen, all of Fed. Rep. of Germany

[73] Assignee: Sartorius GmbH, Fed. Rep. of Germany

[21] Appl. No.: 368,857

[22] Filed: Apr. 15, 1982

[30] Foreign Application Priority Data

May 2, 1981 [DE] Fed. Rep. of Germany ..... 3117394

[51] Int. Cl.[3] ..... H05B 37/00; H05B 39/00

[52] U.S. Cl. ..... 315/169.4; 315/105; 340/813

[58] Field of Search ..... 315/169.4, 106, 105; 340/813

[56] References Cited

U.S. PATENT DOCUMENTS

| | | | |
|---|---|---|---|
| 3,891,983 | 6/1975 | Lee | 340/813 |
| 4,032,818 | 6/1977 | Chan | 340/813 |
| 4,209,729 | 6/1980 | McElroy | 315/105 |
| 4,241,278 | 12/1980 | Walther | 315/106 |

*Primary Examiner*—Harold Dixon

*Attorney, Agent, or Firm*—Eric P. Schellin

[57] ABSTRACT

In conventional fluorescent signaling devices the filament is fed with 50 Hz alternating current and the multiplex frequency of the signal ranges similarly in the area of 50 Hz, so that brightness variations occur with the difference in frequencies. A simple means for avoiding disturbing effect is the circuit of the present invention which divides the heating alternating current voltage into several stages and connects the negative terminal of the supply voltage of the fluorescent signaling device to one of the intermediate stages of the heating alternating current voltage depending on the signaling point that at the instant concerned happens to be lighted.

4 Claims, 5 Drawing Figures

Fig. 2
PRIOR ART
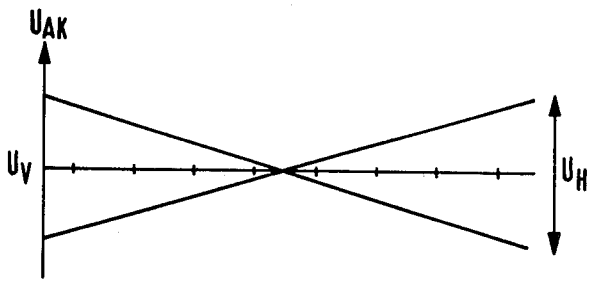
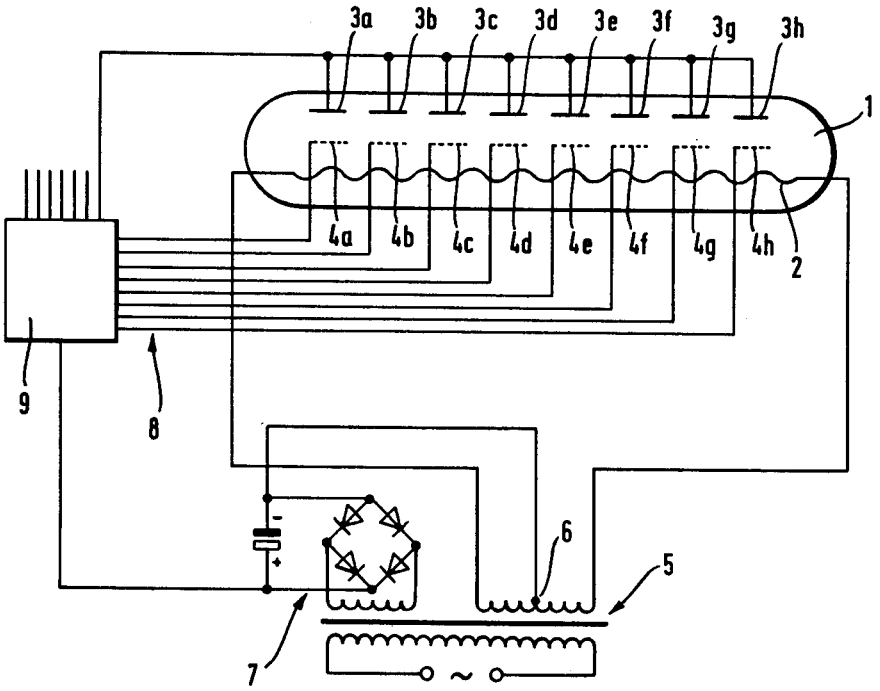
Fig. 1
PRIOR ART

Fig. 5
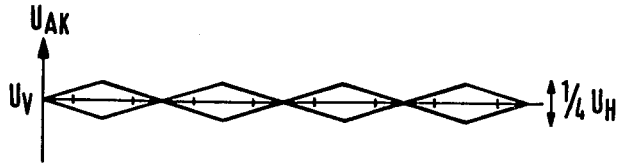
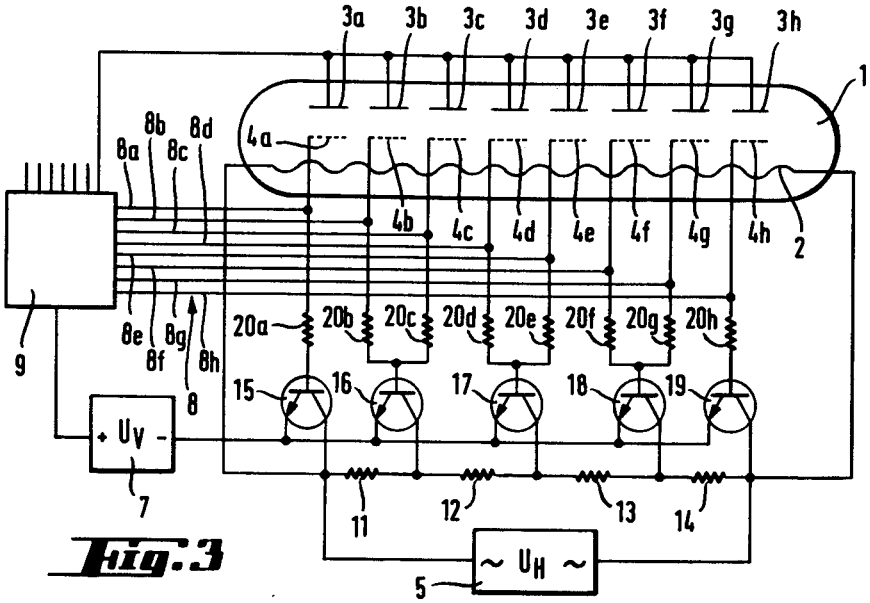
Fig. 3
Fig. 4
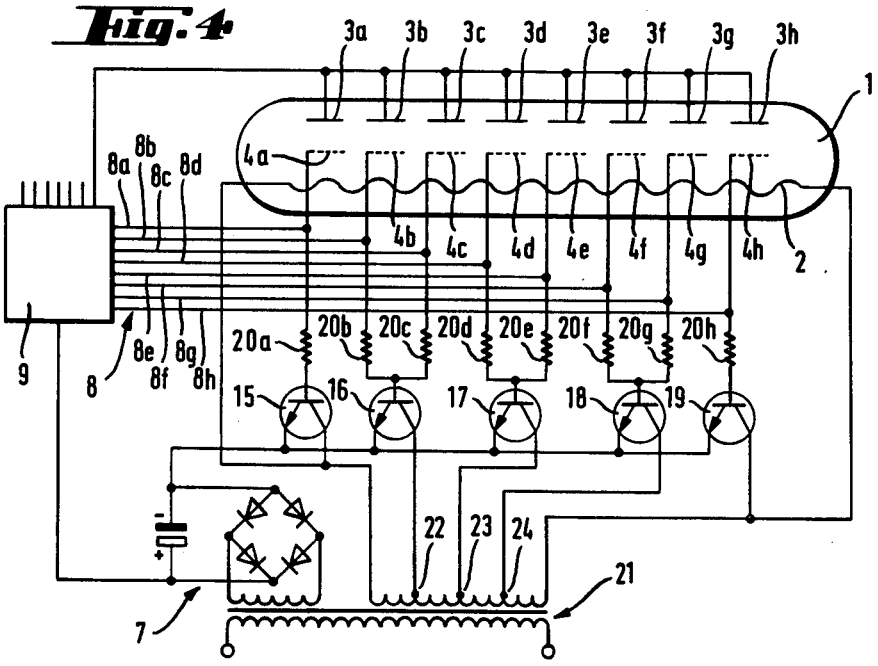

CIRCUIT FOR FLUORESCENT SIGNALING DEVICE

BACKGROUND OF THE INVENTION

1. Field of the Invention

The present invention relates to a circuit for controlling a fluorescent signaling device, in which the circuit contains an alternating current (a.c.) supplied filament, several grids assigned to the various signal points, signaling elements consisting of segments, direct current (d.c.) voltage source which generates a voltage between the filament as cathode and the signaling elements as anode, and a driver circuit whose gating outputs are connected to the individual grids of the fluorescent signaling device.

2. Description of the Prior Art

A conventional circuit of the prior art is shown in FIG. 1. The fluorescent signaling device consists of elongated, evacuated vitreous body 1 within which filament 2 is provided and current is supplied from a.c. voltage source 5. Filament 2 faces signaling elements 3*a*–3*h* which are constructed as 7-segment signaling elements, of which FIG. 2 shows only one segment in each case. Furthermore, grid 4*a*–4*h* is assigned to each point of the fluorescent signaling device. The negative terminal of the d.c. voltage source for supplying the fluorescent signaling device is connected to center tap 6 of heating voltage source 5 and imparts a negative bias to filament 2 which acts as a cathode. The positive terminal of direct voltage source 7 is connected, via driver circuit 9, to signaling elements 3*a*–3*h* which at the instant concerned are to be stimulated and lighted. Driver circuit 9 controls via gating outputs 8 individual grids 4*a*–4*h* and thus determines the point that is to show the signal. D.C. voltage source 7 supplies about 50 volts, while the heating a.c. voltage supplies about 5 volts.

A.C. voltage $U_H$ for supplying filament 2 combines with voltage $U_V$ of voltage source 7, so that cathode/anode voltage $U_{AK}$ at the center points of the signaling device is constant while at the outer points of the signaling device it varies in a 50 Hz rhythm. In FIG. 2 the voltage variation of the assigned heating filament area for signaling element 3*d*, ranges between 0 and $\frac{1}{4}$ of heating voltage $U_H$, for an average of $\frac{1}{8}$ of the heating voltage. For the signaling element 3*a*, however, the voltage variation of the corresponding filament area is between $\frac{3}{4}$ and 4/4 of the heating voltage, for an average of $\frac{7}{8}$ of the heating voltage.

To avoid these variations in the cathode/anode voltage which lead to visible variations in the brightness of the signal, it is customary to select a multiplex frequency signal that is larger than 100 Hz, because then the brightness variations are so rapid that the human eye can no longer perceive or detect them.

However, when the driver circuit in the microprocessor for the signaling device is integrated, the multiplex frequency must be in the range of 50 Hz; and therefore visible variations in brightness occur because of the frequency difference between the 50 Hz filament voltage and the multiplex frequency (surge).

In order to avoid these brightness variations, it is feasible to change the frequency of the filament voltage, either to 0 Hz (d.c. supply) or to about 20 kHz. The d.c. filament however, leads to a drop of the cathode/anode voltage from one end of the signaling device to the other end, so that normally a corresponding drop in brightness results. This drop in brightness could be structurally compensated for, by a modified filament. This, however, leads to cost increases, which, particularly in the case of smaller quantities, is substantial. An increase in the frequency of the heating a.c. voltage by the use of blocking oscillators, requires a high circuit expense for the ferrite transmitter, the transistors for controlling the relatively large currents, and for condensers.

The object of the present invention is to provide a simple, economical circuit which, in spite of the 50 Hz feeding of the filament and a multiplex frequency in the range of 50 Hz prevents visible variations in signal brightness.

SUMMARY

According to the present invention, the above stated object is accomplished by providing circuit elements which subdivide the a.c. voltage into several stages for supplying the filament; providing circuit elements which are controlled by the gating outputs of the driver circuit; and connecting the negative terminal of a d.c. voltage source to one of the intermediate stages of the heating a.c. voltage. The circuit elements are controlled by the outputs of the driver circuit in such a manner that the cathode/anode voltage at the signal point to be illuminated differs as little as possible from its rated value.

The circuit elements for subdividing the heating a.c. voltage may in an embodiment comprise an ohmic voltage divider.

When the heating a.c. voltage is tapped off a transformer, the circuit elements for subdividing the heating a.c. voltage can, in another embodiment, comprise several taps of the transformer winding.

The circuit elements which are controlled by the gating outputs of the driver circuit and connect the negative terminal of the d.c. voltage source to one of the intermediate stages of the heating a.c. voltage are comprised of transistors. These transistors are not subject to great demands since they must switch only the small cathode current and not the much larger heating current.

BRIEF DESCRIPTION OF THE DRAWINGS

The invention is described with the aid of FIGS. 3, 4 and 5; FIGS. 1 and 2 are illustrative of the prior art.

FIG. 1, is a schematic circuit diagram of a fluorescent signaling device circuit according to prior art;

FIG. 2, is a diagram of the voltage variations between the cathode and the anode of the circuit in FIG. 1;

FIG. 3, is a schematic circuit diagram of a circuit according to the present invention with ohmic voltage divider;

FIG. 4, is a schematic circuit diagram of a circuit according to the present invention with inductive voltage divider; and FIG. 5, is a diagram of the voltage variations between the cathode and the anode of the circuits in FIG. 3 or 4.

DETAILED DESCRIPTION OF THE PREFERRED EMBODIMENTS

The circuit of FIG. 3 comprises fluorescent signaling element 1 having filament 2, signaling elements 3*a*–3*h* and grids 4*a*–4*h*. In addition to the filament, an ohmic voltage divider or a first circuit means, comprising resistors 11, 12, 13 and 14 is connected to heating a.c.

voltage source 5. The resistance value of the individual resistors 11 to 14 is the same, so that the heating voltage is subdivided into four equal stages.

The positive terminal of d.c. voltage source 7 for suppling the fluorescent signal device is connected, via driver circuit 9 to those segments of signaling elements 3*a*–3*h* which at the instant concerned are to be lighted. The negative terminal is connected by a second circuit means, via one of the transistors 15, 16, 17, 18 or 19 to one of the two ends or one of the intermediate taps of voltage divider 11–14. When, signaling element 3*a* at the extreme left of fluorescent signaling element 1 is triggered, grid 4 receives via corresponding gating line 8*a* a positive voltage, whereby, via decoupling resistor 20*a* transistor 15 is simultaneously opened. The other transistors 16 to 19 remain closed. Accordingly, the left end of the filament receives the rated potential relative to the anode. When subsequently second signaling element 3*b* is stimulated, grid 4*b* receives via the corresponding gating line 8*b* a positive voltage via decoupling resistor 20*b*, transistor 16 is opened. Accordingly, the filament, in the middle between signaling element 3*b* and signaling element 3*c*, receives the rated potential relative to the anode. The triggering of the other points in the signaling device functions much the same way. In FIG. 5, small variations thus obtained of cathode/anode voltage $U_{AK}$ are recorded. For all signaling elements 3*a*–3*h*, the voltage variation of the corresponding filament area during the triggering ranges between 0 and $\frac{1}{4}$ of heating voltage $U_H$, for an average of $\frac{1}{8}$ of the heating voltage. This means that for the outermost points, the present circuit when compared with the circuit of FIG. 1 average voltage variation is improved by a factor 7. This improvement is by experience sufficient to suppress the brightness variations below the visibility limit. Should in exceptional cases this not be the case, a still better constancy of the cathode/anode voltage may be achieved at a somewhat higher expense, by a finer subdivision of the voltage divider and additional circuit transistors.

FIG. 4 shows another embodiment of the circuit. It differs from FIG. 3 in that the first circuit means comprising a ohmic voltage divider is replaced by a first circuit means comprising an inductive voltage divider. In fact, when the heating a.c. voltage is tapped off transformer 21 an inductive voltage division may be very easily obtained by taps 22, 23 and 24 at the transformer winding without the need for additional structural elements. In the other details the circuit of FIG. 4 corresponds to the circuit of FIG. 3, so that a repeated explanation of these details can be dispensed with. In just the same manner the voltage division shown in FIG. 5 applies also the circuit of FIG. 4.

While the present invention has been disclosed in connection with the illustrated embodiments it is not to be so limited but is to be limited solely by the claims.

What is claimed is:

1. A circuit for controlling a fluorescent signaling device that comprises an alternating current voltage supplied filament, a plurality of grids assigned to a plurality of signal points, and a plurality of signaling elements comprising segments, a direct current voltage source which generates a voltage between said filament as a cathode and said plurality of signal elements as anodes, and a driver circuit having gating outputs that are connected to said plurality of individual grids of said fluorescent signaling device, characterized in that:

First circuit means subdivide said alternating current voltage for supplying said filament into several stages, and that second circuit means are controlled by gating outputs of said driver circuit and connect the negative terminal of said direct current voltage source to one of the intermediate stages of said alternating current voltage.

2. Circuit as defined by claim 1, wherein said first circuit means for subdividing said alternating current voltage comprise an ohmic voltage divider.

3. Circuit as defined by claim 1, wherein said alternating current voltage is tapped off a transformer and that said first circuit means for subdividing said alternating current voltage comprise a plurality of taps of said transformer winding.

4. Circuit as defined by either claims 2 or 3, wherein said second circuit means is controlled by said gating outputs of said driver circuit and connects the negative terminal of said direct current voltage source to one of said intermediate stages of said alternating current voltage and comprise transistors.

* * * * *